United States Patent [19]

Kesel et al.

[11] Patent Number: 4,796,934

[45] Date of Patent: Jan. 10, 1989

[54] RELEASE LINKAGE FOR DOOR LATCH

[75] Inventors: Thomas A. Kesel, Dearborn; Robert M. Paszko, Canton, both of Mich.

[73] Assignee: Ford Motor Company, Dearborn, Mich.

[21] Appl. No.: 137,638

[22] Filed: Dec. 24, 1987

[51] Int. Cl.[4] ..... E05B 65/20; F05C 3/26

[52] U.S. Cl. ..... 292/336.3; 292/216; 292/221; 292/223; 292/DIG. 62

[58] Field of Search ..... 292/97, 123, 139, 167, 292/196, 216, 221, 223, 336.3, DIG. 62

[56] References Cited

U.S. PATENT DOCUMENTS

| | | | |
|---|---|---|---|
| 3,525,545 | 8/1970 | Leslie | 292/216 |
| 3,848,909 | 11/1974 | Foley | 292/216 |
| 3,899,202 | 8/1975 | Rickles | 292/216 |
| 4,093,289 | 6/1978 | Inabayashi | 292/DIG. 2 X |
| 4,585,261 | 4/1986 | Adams et al. | 292/216 |

*Primary Examiner*—Kenneth J. Dorner
*Assistant Examiner*—Peter R. Brown
*Attorney, Agent, or Firm*—Daniel M. Stock; Clifford L. Sadler

[57] ABSTRACT

A release linkage for an automotive vehicle door latch provides a link which is vertically adjustably positioned with respect to a pivotal connection to the door's outside handle and is connected with lost motion to a latch actuating rod which is carried between the door handle and a release lever for the latch.

12 Claims, 3 Drawing Sheets

RELEASE LINKAGE FOR DOOR LATCH

BACKGROUND OF THE INVENTION

The present invention relates generally to latch mechanisms for doors, and more specifically, for the doors of automobiles or other vehicle bodies. It relates more specifically to operating components associated with the vehicle doors for releasing or unlatching the latch mechanism.

DESCRIPTION OF THE PRIOR ART

Transmitting actuating force from the outside door handle of an automobile to operating elements of the door's latch mechanism to effect the release of the latch and permit opening the door has generally required relatively precise positioning of the door handle to latch and certain intermediate components. U.S. Pat. No. 2,997,324, Wolfslayer, and U.S. Pat. No. 3,121,579, Di Salvo et al, are exemplary of release linkage systems that have been used in the automotive industry in the past. The pivot points in these latch release mechanisms require exact positioning at least vertically and horizontally with respect to the vehicle and its doors. Even with modern accurate metal stamping techniques and modern assembly techniques for the doors and for the vehicle itself, the proper assembly of a compact and efficient door release linkage door mechanism can necessitate significant time consuming adjustment at final assembly.

SUMMARY OF THE INVENTION

Responsive to deficiencies in the prior art release linkage mechanisms, it is a primary object of the present invention to provide a release linkage mechanism that permits assembly of the door embodying a latch with the release linkage mechanism with a minimal number of parts relatively insensitive to the variations in positioning between the door's outside handle and its latch mechanism.

According to a feature of the present invention, a cranklike actuating rod extends longitudinally of the vehicle from a release lever of the latch mechanism, and has an actuating portion received in a slot formed and extending axially of a rod near one end of the rod. At the other end of the rod, a clip engages the rod and is pivotally connected to the door handle. During assembly of the door, the actuating link is carried with the latch mechanism and loaded by gravity against it operating rod. The clip is pivotally mounted on the door handle and receives and precisely locates the rod in snapfit relationship.

BRIEF DESCRIPTION OF THE DRAWINGS

These and other objects and features will become apparent upon reading the following description with reference to the accompanying drawings in which.

DESCRIPTION OF THE PREFERRED EMBODIMENT

Figure 1:
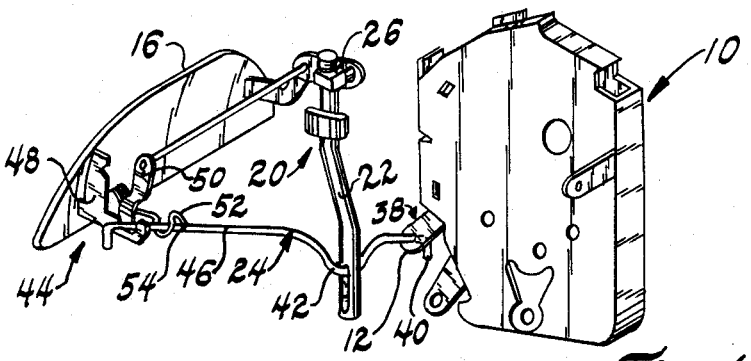
FIG. 1 is a perspective view of the door latch release linkage of the present invention in its assembled position.
Figure 8:
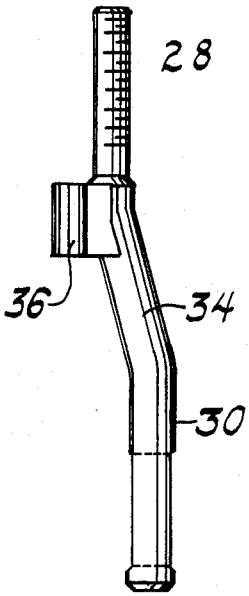
FIG. 8 is a side view of the link of FIG. 7.
Figure 9:
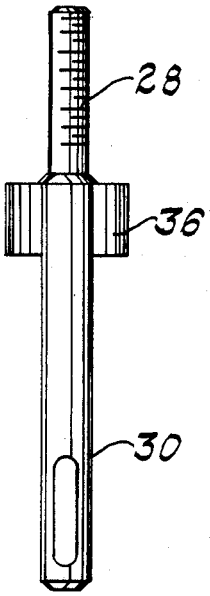
FIG. 9 is a view of the link of FIG. 7.

Turning now to the drawings and particularly to FIG. 1 thereof. A door latch 10 is illustrated is simplified fashion. Those skilled in the automotive body arts will understand, of course, that the latch 10 is installed preferably near the trailing edge of the swingable vehicle door. It necessarily includes a release lever 12 which is pivotally mounted in known fashion to move between the latched position shown in FIG. 1 and the unlatched position shown in FIG. 2. The door 14, a portion of which can be seen in FIG. 4, includes an outside door handle 16 pivotally mounted about an axis 18 longitudinal of the vehicle. The release linkage indicated generally at 20 of the present invention transmits forced to effect releasing movement of the latch 10 from the handle 16. The release linkage 20 consists essentially of a release link 22 an actuating rod 24, and a mounting clip 26. The link 22 includes an upper mounting portion 28, which is preferably threaded or knurled for engaging the clip 26. It also includes a lower actuating portion 30 having an elongated slot 32 formed through it. In the preferred embodiment illustrated, the mounting portion 28 and the actuating portion 30 are offset and joined by an oblique portion 34 as may best be seen in FIG. 8. The link 22 further preferably includes an enlarged button portion 36 formed proximate the mounting portion 28 for facilitating assembly as will be later described.

The actuating rod 24 includes a first hooked end portion 38 terminating in an actuating leg 40 insertable into engagement with the release lever 12. The actuating rod 24 further includes a bowed-out actuating portion 42 received in the slot 32 of the link 22. The actuating rod 24 terminates in a second hook portion 44 joined with the actuating Portion 42 by a support leg 46. The support leg 46 and the hook 44 are carried in a support portion 48 formed on a pivot plate 50 of the handle 16 to effect simple support of the actuating rod 26 as may best be seen in FIG. 1. A coil spring 52, grounded at one end on the handle 18 has an engaging tang 54 at its other end for loading the support portion 46.

Figure 4:
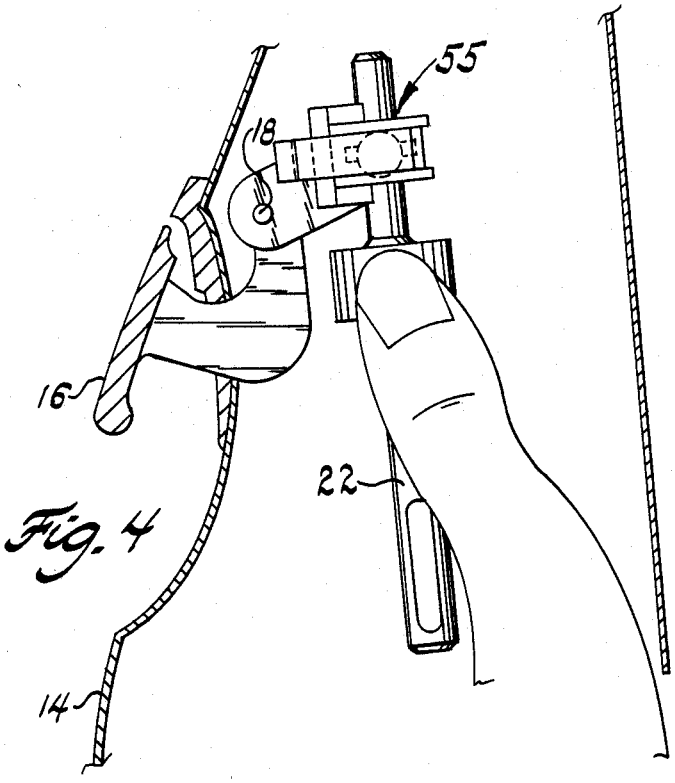
FIG. 4 is an enlarged cross-sectional view of the portion of the linkage showing attachment to the door outside handle.
Figure 5:
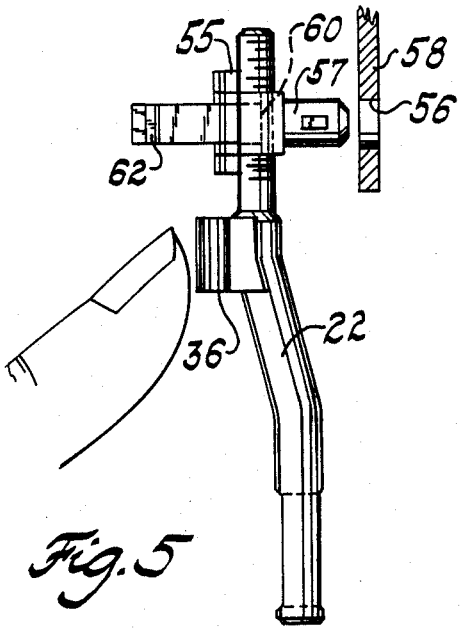
FIG. 5 is a side view of the link of the release linkage with a cross-sectional view of a portion of the handle prior to and engagement of the clip.
Figure 6:
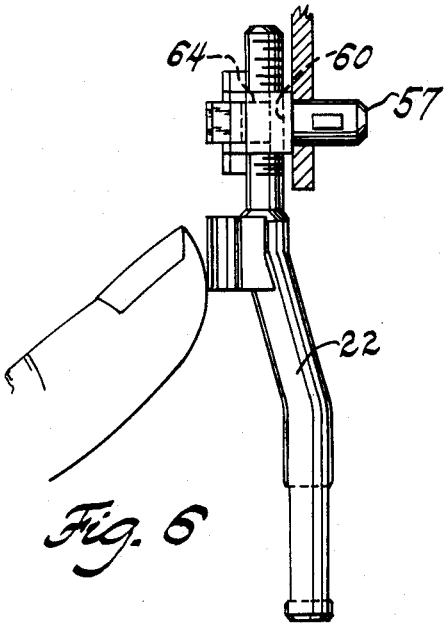
FIG. 6 is a view similar to FIG. 5 showing the link assembled into the handle and the clip engaged.
Figure 10:
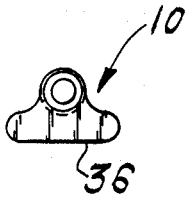
FIG. 10 is a top view of the link of FIG. 7.
Figure 7:
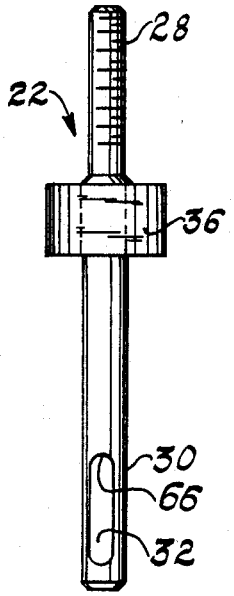
FIG. 7 is a front view of the link of the release linkage.

Turning now to FIGS. 4, 5 and 6, the mounting clip 26 includes a gripping portion 55 for selective engagement around the mounting portion 28 of the link 22 and a mounting pin portion 57. An aperture 56 is formed through a portion 58 of the handle 16. The aperture 56 is sized to receive the pin portion 57 in slip-fit fashion to permit certain pivotal movement of the handle 16 with respect to the pin portion 57.

When the parts of the release linkage 20 are placed in the position shown in FIG. 1, the link 22 is urged by gravity to rest against the actuating portion 42 of the rod 24. When the clip 26 is in the open position as shown in FIG. 5, it may be slid along the mounting portion 28 until its pin portion 57 registers with the aperture 56. Final assembly is then accomplished by closing the clip 26, as shown in FIG. 6 and pressing button portion 36 to insert the pin portion 57 into the aperture 56.

As here illustrated, The clip 26 includes a partial bore 60 for receiving mounting portion 28 in locking fashion upon clamping engagement of a swingably mounted cover 62, which includes a matching partial bore 64. Such clips are known in the automotive assembly arts and any are acceptable which will allow axial adjustable positioning of the link 22.

Figure 2:
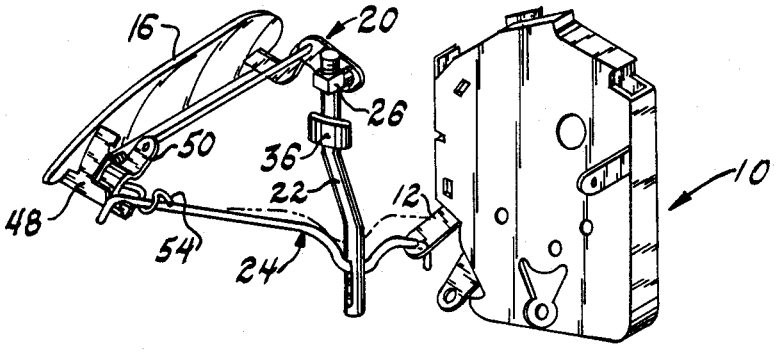
FIG. 2 is a perspective view showing the linkage in an actuated position.
Figure 3:
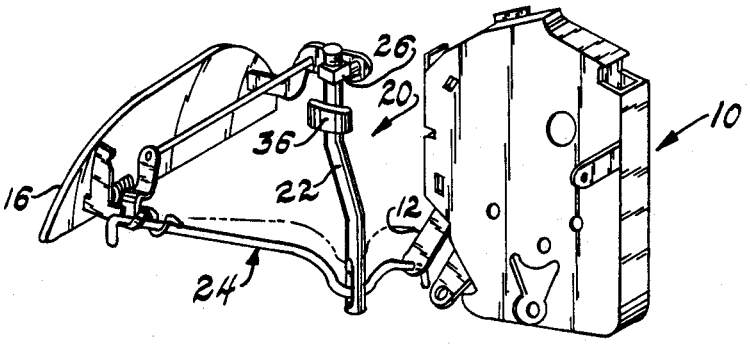
FIG. 3 is a perspective view showing the linkage in a freewheeling position.

Upon lifting the outside door handle 16 as shown in FIG. 2, the link 22 is driven downwardly with respect to the pivotal axis 18 of the handle 16. Engagement of the upper terminus 66 of the slot 32 with the actuating portion 42 of the actuating rod 24 effects downward movement of the actuating rod 24 to drive the release lever 12 counterclockwise as viewed in perspective in FIGS. 1–3. Operation of the spring 50 to return the handle 16 to its normal position of FIG. 1 also returns the rod 24. This pivotal movement is permitted because of the pivotal connection between the link 22 and the handle 16 effected through the clip 26 and by the relationship between the actuating portion 42 and the slot 32. If the lever 12 is actuated, however, by another element, such as the inside door handle (not shown), the actuating rod 24 may be moved downwardly without effecting any movement of the link 22 or the door handle 16.

While only one embodiment of the invention has been described, others may be possible without departing from the scope of the appended claims.

We claim:

1. A release linkage for the latch of an automotive vehicle door, the latch having a release lever pivotally mounted for operative movement between latched and unlatched conditions, and the door having an inside handle mounted thereon and connected to the release lever for effecting the operative movement and an outside handle mounted for pivotal movement with respect to the door, the release linkage comprising:

a mounting clip pivotally mounted on the outside door handle;

a release link clampingly engaged by the mounting clip;

an elongated actuating rod having one end supported on the outside door handle and the other end operatively connected to the release level and having an intermediate actuating portion;

and lost motion means for interconnecting the release link and the actuating rod actuating Portion to prevent movement of the release lever in response to operative movement of the inside handle.

2. A release linkage as defined in claim 1 wherein the lost motion means comprises an elongated slot formed through the release link and receiving the actuating rod actuating portion.

3. A release linkage as defined in claim 1 wherein a coil spring means is operatively interposed between the outside door handle and the door to bias the outside door handle toward a position corresponding to the unlatched condition of the latch and wherein the one end of the actuating rod is supported on a portion of the coil spring means.

4. A release linkage as defined in claim 1 wherein the mounting clip includes a pin portion insertable into the outside handle for effecting the pivotal mounting of the clip and wherein the release link includes a button portion for facilitating the insertion of the pin portion into the outside door handle.

5. A release linkage as defined in claim 1 wherein the elongated actuating portion includes surfaces axially offset from its ends.

6. A release linkage for the latch of an automotive vehicle door, the latch having a release lever pivotally mounted for operative movement between latched and unlatched conditions, and the door having an inside handle mounted thereon and connected to the release lever for effecting the operative movement and an outside handle mounted for pivotal movement with respect to the door, the release linkage comprising:

a mounting clip pivotally mounted on the outside door handle;

a release link variably positionable within the mounting clip and fixedly secured thereto;

an elongated actuating rod having one end supported on the outside door handle and the other end operatively connected to the release lever and having an intermediate actuating portion;

and lost motion means for interconnecting the release link and the actuating rod actuating portion.

7. A release linkage as defined in claim 6 wherein the lost motion means comprises an elongated slot formed through the release link and receiving the actuating rod actuating portion.

8. A release linkage as defined in claim 6 wherein a coil spring means is operatively interposed between the outside door handle and the door to bias the outside door handle toward a position corresponding to the unlatched condition of the latch and wherein the one end of the actuating rod is supported on a portion of the coil spring means.

9. A release linkage for the latch of an automotive vehicle door, the latch having a release lever pivotally mounted for operative movement between latched and unlatched conditions, and the door having an inside handle mounted thereon and connected to the release lever for effecting the operative movement and an outside handle mounted for pivotal movement with respect to the door, the release linkage comprising:

a mounting clip pivotally mounted on the outside door handle;

a release link variably positionable within the mounting clip and fixedly secured thereto and suspending therefrom to effect vertical reciprocal movement in response to pivotal movement of the outside door handle;

an elongated actuating rod having portions positioned below the outside door handle and having one end supported on the outside door handle and the other end operatively connected to the release lever and having an intermediate actuating portion;

and lost motion means for interconnecting the end of the release link distal the outside door handle and the actuating rod actuating portion.

10. A release linkage as defined in claim 9 wherein the lost motion means comprises an axially extending elongated slot formed through the release link and receiving the actuating rod actuating portion.

11. A release linkage as defined in claim 10 wherein the upper end of the slot abuttingly engages the rod actuating portion.

12. A release linkage as defined in claim 10 wherein:

a coil spring is operatively interposed between the outside door handle and the door to bias the outside door handle toward a position corresponding to the unlatched condition of the latch;

the one end of the actuating rod is supported on a portion of the coil spring; and the upper end of the slot abuttingly engages the rod actuating portion when the outside handle is biased to the unlatched position.

* * * * *